US005550340A

United States Patent [19]

Ogawa

[11] Patent Number: 5,550,340

[45] Date of Patent: Aug. 27, 1996

[54] SWITCH DEVICE

[75] Inventor: Tomoharu Ogawa, Aichi, Japan

[73] Assignee: Kabushiki Kaisha Tokai Rika Denki Seisakusho, Aichi, Japan

[21] Appl. No.: 370,721

[22] Filed: Dec. 12, 1994

[30] Foreign Application Priority Data

Dec. 13, 1993 [JP] Japan ..... 5-66267 U

[51] Int. Cl.[6] ..... H01H 1/64

[52] U.S. Cl. ..... 200/295; 200/293

[58] Field of Search ..... 200/293.1, 294, 200/295, 296, 301, 293, 300

[56] References Cited

U.S. PATENT DOCUMENTS 3,621,173 11/1971 O'Cheskey ..... 200/295

4,454,565 6/1984 Krasij et al. ..... 200/295

5,130,505 7/1992 Koehler ..... 200/294

5,293,015 3/1994 Yuda ..... 200/294

*Primary Examiner*—David J. Walczak

*Attorney, Agent, or Firm*—Finnegan, Henderson, Farabow, Garrett & Dunner, L.L.P.

[57] ABSTRACT

In a switch device, a bendable mounting piece is extended from the switch body, which is abutted against the mounting surface of a base and secured to the latter with a screw, the switch body includes a positioning portion which is abutted against a positioning surface which is set back from the mounting surface, thus forming a step, and a leaf spring is spread over the outer side surface of the mounting piece and the outer side surface of the switch body which, when tightened together with the mounting piece, urges the switch body so that the positioning portion of the switch body is moved towards the positioning surface of the switch mounting unit.

1 Claim, 3 Drawing Sheets

SWITCH DEVICE

BACKGROUND OF THE INVENTION

The present invention relates to a switch device which is improved in structure to mount its switch body on a switch mounting unit.

An example of a switch device of this type is as shown in FIG. 6. A switch mounting unit 2, on which a switch body 1 is to be mounted, is made up of a base 3 and a positioning member 4 set on the base 3. The right end surface of the base 3 is employed as a mounting surface 3*a*, and the right end surface of the positioning member 4 is employed as a positioning surface 4*a*. The positioning surface 4*a* is set back from the mounting surface 3*a*, thus providing a step. The switch body 1 has a mounting protrusion la at the right end which is extended downwardly, and a positioning portion lb on the lower surface. The switch body 1 is fixedly mounted on the switch mounting unit 2 as follows: The positioning portion 1*b* of the switch body 1 is set on the positioning surface 4*a* of the switch mounting unit 2 while the mounting protrusion 1*a* is set on the mounting surface 3*a* of the switch mounting unit 2. Under this condition, the switch body 1 is secured to the switch mounting unit 2 with a screw 5.

The above-described conventional switch device still involves a problem to be solved. That is, the switch device is generally manufactured on a large scale. In the switch devices thus manufactured, the positioning surfaces 4*a* are not always equal in position because of the variations in manufacture of the switch mounting units 2 (including the bases 3 and the positioning members 4). Hence, when the switch body 1 is mounted on the switch mounting unit 2, depending on the switch device, a gap is formed between the positioning surface 4a and the positioning portion lb as shown in FIG. 7, that is, the switch body 1 is not accurately positioned.

SUMMARY OF THE INVENTION

Accordingly, an object of the present invention is to provide a switch device in which, when the switch body is mounted on the switch mounting unit, the positioning portion of the switch body is positively abutted against the positioning surface of the switch mounting unit, so that the switch body is improved in positioning accuracy.

The foregoing object of the invention has been achieved by the provision of a switch device which, according to the invention, comprises: a deformable mounting piece extended from a switch body, the mounting piece being abutted against a mounting surface of a switch mounting unit, and secured to the mounting surface with a screw; a positioning portion integral with the switch body, the positioning portion being abutted against a positioning surface which is set back from the mounting surface, thus forming a step; and a leaf spring arranged in such a manner as to spread over the outer surface of the mounting piece and the outer surface of the switch body, the leaf spring together with the mounting piece being tightened to urge the switch body so that the positioning portion of the switch body is abutted against the positioning surface.

With the switch device of the invention, the switch body is fixedly mounted on the switch mounting unit as follows: The mounting piece extended from the switch body is secured to the switch mounting unit with the screw while being kept abutted against the mounting surface of the switch mounting unit. In this operation, the mounting piece together with the leaf spring is tightened with the screw, so that the positioning portion of the switch body is urged by the leaf spring towards the positioning surface of the switch mounting unit. Hence, when the switch body is mounted on the switch mounting unit, the positioning portion of the switch body is positively abutted against the positioning surface of the switch mounting unit so that positioning accuracy of the switch body is imroved.

DETAILED DESCRIPTION OF THE INVENTION

A switch device for detecting the position of a shift lever of a shift lever device (of column shift type) for an automatic gear, which constitutes an embodiment of the present invention, will be described with reference to FIGS. 1 through 5.

Figure 1:
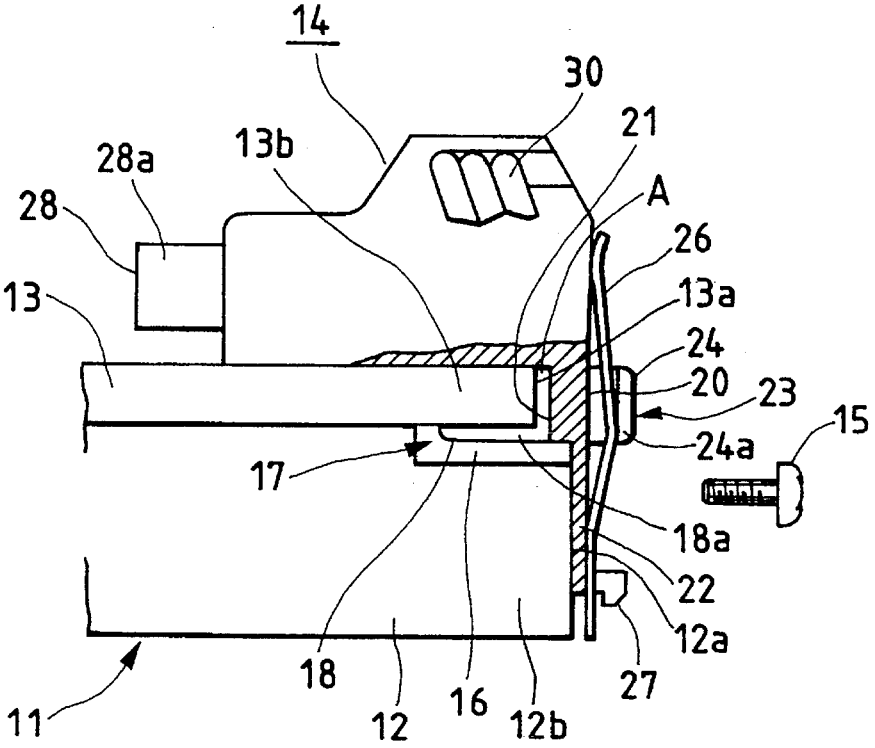
FIG. 1 is a fragmentary front view of a switch device mounted on a switch mounting unit, which constitutes an embodiment of the present invention.
Figure 2:
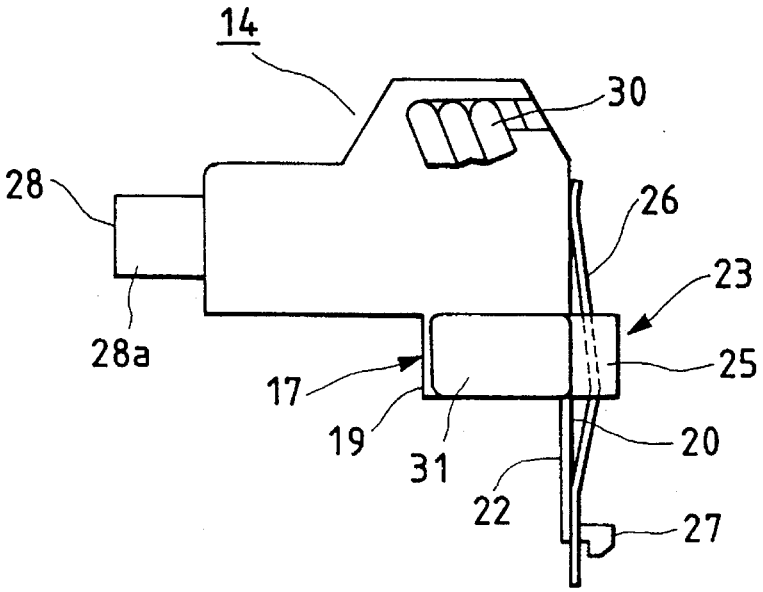
FIG. 2 is a front view of a switch body and a leaf spring in the switch device of the present invention.

FIG. 1 shows the switch device mounted on a switch mounting unit 11. The switch mounting unit 11, as shown in FIG. 1, includes: a base 12 of the shift lever device; and a gate board 13 which is fixedly mounted on the base 12, for instance, with screws. The gate board 13 has a plurality of engaging recesses for holding the shift lever at a plurality of positions. The shift lever is arranged on the base 12 in such a manner that it can be shifted to a desired position.

The right end surface of the base 12 is employed as a mounting surface 12*a* on which the switch body 14 is mounted. A threaded hole is formed in the mounting surface 12*a*, which is engaged with a mounting screw 15. The right end surface of the gate board 13 is employed as a positioning surface 13*a*. The positioning surface 13*a* is slightly set back from the mounting surface 12*a*, thus providing a step. A gap 16 is formed between the right end portion 13*b* of the gate board 13 and the right end portion 12*b* of the base 12.

The switch body 14 is substantially in the form of a rectangular box. An engaging portion 17 is extended downwardly from the lower surface of the right end portion of the switch body 14 as shown in FIGS. 1 through 4 so that it is engaged with the right end portion 13*b* of the gate board 13. The engaging portion 17 is made up of a pair of protruded pieces 18 and 19 which are confronted with each other and have pawls 18*a* and 19*a* at the lower ends, respectively. More specifically, the engaging portion 17 is so designed that the right end portion 13*b* of the gate board 13 is fitted in the space defined by the lower surface of the switch body 14 and the pair of protruded pieces 18 and 19 having the pawls 18*a* and 19*a*.

The switch body 14 has a protrusion 20 at the right end, which is extended downwardly. The base portion of the protrusion 20 is integral with the above-described pair of protruded pieces 18 and 19; that is, the base portion and the protruded pieces are arranged substantially in the form of the character "U". The base portion of the protrusion 20 is larger in wall thickness than the remaining end portion. The inner half (or the left half in FIG. 1) of the base portion of the protrusion 20 serves as a positioning portion 21. The end portion of the protrusion 20, being small in thickness, is elastically deformable, thus being employed as a mounting piece 22. The latter 22 has a through-hole 22*a* (see FIG. 4) into which the screw 15 is inserted. The mounting piece 22 is abutted against the mounting surface 12*a* of the base 12, and secured to the latter 12 with the screw 15 inserted into the through-hole 22*a*.

Figure 3:
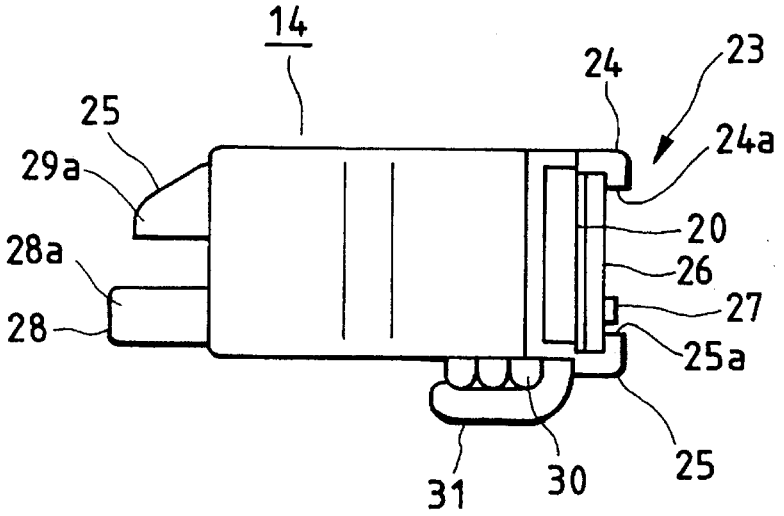
FIG. 3 is a top view of the switch body and the leaf spring.
Figure 4:
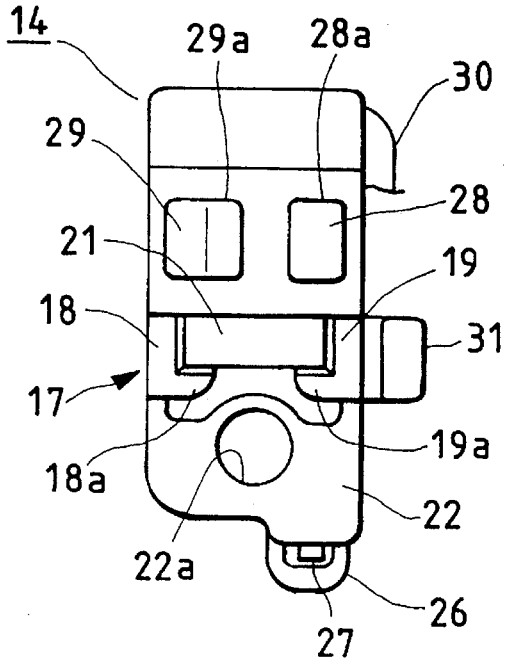
FIG. 4 is a left side view of the switch body.

The protrusion 20 has a leaf spring holder 23 on the right side as viewed in FIG. 1 or 3. The leaf spring holder 23 comprises a pair of holding pieces 24 and 25 which are confronted with each other, and have pawls 24*a* and 25*a* at the ends, respectively. A leaf spring 26 is fixedly fitted in between the outer surface of the protrusion 20 and the holding pawls pieces 24 and 25 having the pawls 24*a* and 25*a*. An engaging pawl 27 is extended from the end portion (the lower end portion) of the mounting piece 22 to the right in FIG. 1. The engaging pawl 27 is adapted to engage with an engaging hole 26*a* (see FIG. 5) formed in the lower end portion of the leaf spring 26.

Figure 5:
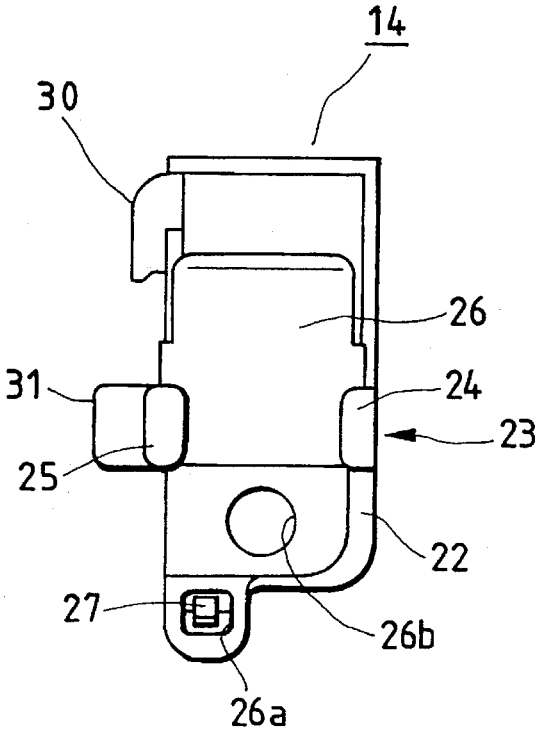
FIG. 5 is a right side view of the switch body and the leaf spring.

The leaf spring 26 is slightly bent as shown in FIG. 1. Since the leaf spring 26 is held in the above-described manner, it is spread over the outer surface of the mounting piece 22 and the outer surface of the switch body 14. As shown in FIG. 5, a through-hole 26*b* is formed in the lower end portion of the leaf spring 26, into which the screw 15 is inserted to fixedly secure the leaf spring 26 and the mounting piece 22 to the base 12.

Two operating pieces 28 and 29 are provided in the switch body 14 as shown in FIGS. 1 through 4 in such a manner that they are movable right and left, and their end portions 28*a* and 29*a* are protruded from the left end face of the switch body 14. The operating pieces 28 and 29 have movable contacts, respectively; and stationary contacts are provided in the switch body 14 which are engageable with the movable contacts, thus providing two switches. Return springs are provided in the switch body 14 to urge the operating pieces 28 and 29 to the left in FIGS. 1, 2 and 3. With the operating pieces 28 and 29 protruded from the switch body, those switches are held turned off. When one of the operating pieces is pushed in, the respective switch is turned on.

Three lead wires connected to the switches are laid over the upper portion of the side-surface of the switch body 14. A guide 31 for guiding the lead wires 30 is provided outside a protruded portion 19 of the switch body 14.

A method of mounting the switch device thus constructed will be described.

Before the switch body 14 is mounted on the switch mounting unit 11, the leaf spring 26 is temporarily held on the switch body 14. More specifically, the leaf spring 26 is inserted into the space from above which is defined by the holding pieces 24 and 25 having the pawls 24*a* and 25*b* and the outer surface of the protrusion 20. The engaging hole 26*a* of the leaf spring 26 is engaged with the engaging pawl 27 of the mounting piece 22 of the switch body 14 as follows: With the mounting piece 22 deflected to the left in FIG. 1, the leaf spring 26 is moved downwardly until the engaging hole 26*a* reaches the engaging pawl 27. Under this condition, the mounting piece 22 is restored to cause the engaging pawl 27 to engage with the engaging hole 26*a*. Thus, the leaf spring 26 has been temporarily held on the switch body 14.

It should be noted that, with the leaf spring 26 temporarily held in the above-described manner, the through-hole 26*b* of the leaf spring 26 is coaxial with the through-hole 22*a* of the mounting piece 22.

The switch body 14, on which the leaf spring 26 has been temporarily held, is mounted on the switch mounting unit 11 as follows: The mounting piece 22 of the switch body 14 is abutted against the mounting surface 12*a* of the base 12 of the switch mounting unit 11, and the screw 15 is engaged through the through-hole 26*b* of the leaf spring 26 and the through-hole 22*a* of the mounting piece 22 with the threaded hole formed in the mounting surface 12*a*.

Figure 6:
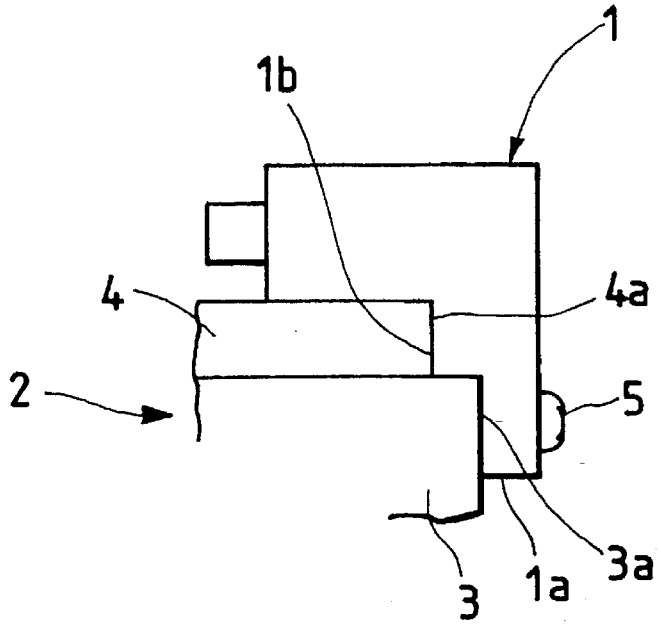
FIG. 6 PRIOR ART
FIG. 6 is a front view showing a way of mounting a conventional switch device on a switch mounting unit.
Figure 7:
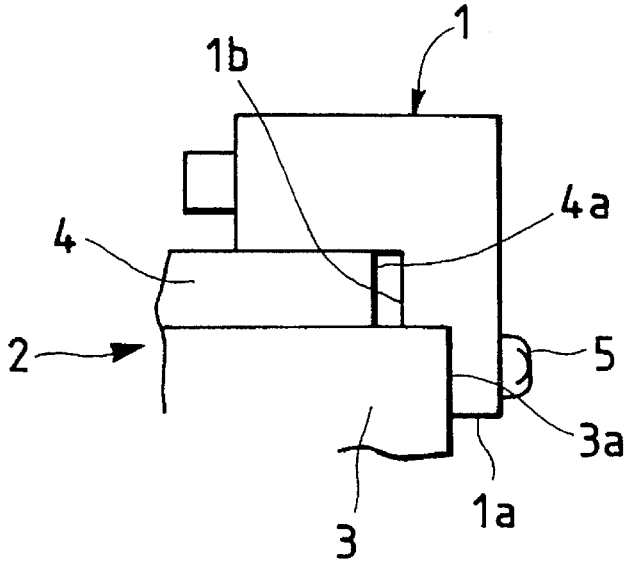
FIG. 7 PRIOR ART
FIG. 7 is a front view showing another way of mounting the conventional switch device.

In this operation, there may be a gap A between the positioning portion 21 of the switch body 14 and the positioning surface 13*a* of the gate board 13 before the screw 15 is tightened. However, as the screw 15 is tightened, the leaf spring 26 together with the mounting piece 22 is pressed by the screw 15, so that the base portion of the mounting piece 22 is bent by the elastic force of the leaf spring 26, whereby the switch body 14 is moved to the left in FIG. 1; that is, the positioning portion 21 of the switch body 14 is moved to abut against the positioning surface 13*a* of the gate board 13. Thus, when the switch body 14 is fixedly mounted on the switch mounting unit 11, the positioning portion 21 of the switch body 14 is positively held abutted against the positioning surface 13a of the gate board 13. This means that, in the switch device of the invention, the switch body 14 is much higher in positioning accuracy than the switch body in the conventional switch device (see FIGS. 6 and 7).

In the above-described embodiment, the leaf spring 26 is temporarily held on the switch body 14 before the latter 14 is mounted on the switch mounting unit 11. Hence, with the switch device of the invention, it is unnecessary to hold the leaf spring 26 by hand in mounting the switch body 14 on the switch mounting unit 11; that is, the switch body 14 can be mounted on the switch mounting unit 11 with ease. Furthermore, since the leaf spring 26 is temporarily held on the switch body 14; that is, the leaf spring and the switch body 14 are provided as one unit, they can be readily handled for instance when the components are transported.

In the above-described embodiment, the leaf spring 26 is temporarily held by the leaf spring holder 23 and the engaging pawl 27; however, the invention is not .limited thereto or thereby. For instance, the embodiment may be modified so that the mounting piece 22 has a female-threaded hole instead of the through-hole so that the leaf spring 26 may be temporarily held on the switch body 14 with the screw 15. The modification has substantially the same effects as the above-described embodiment.

As is apparent from the above description, the leaf spring is spread over the outer side surface of the mounting piece and the outer side surface of the switch body which, when tightened together with the mounting piece, urges the switch body so that the positioning portion of the switch body is moved towards the positioning surface of the switch mounting unit. Hence, when the switch body is mounted on the switch mounting unit, the positioning portion of the switch body is positively held abutted against the positioning surface of the switch mounting unit; that is, the switch body is accurately mounted on the switch mounting unit. This effect should be highly appreciated.

What is claimed is:

1. A switch device comprising:

a deformable mounting piece extended from a switch body, said mounting piece being abutted against a mounting surface of a switch mounting unit, and secured to said mounting surface with a screw;

a positioning portion integral with said switch body, said positioning portion being abutted against a positioning surface of said switch mounting unit, said positioning surface being set back from said mounting surface, thus forming a step; and a leaf spring formed separately from said switch mounting unit and arranged in such a manner as to spread over an outer surface of said deformable mounting piece and an outer surface of said switch body and further arranged such that it does not contact said switch mounting unit, said leaf spring together with said mounting piece being tightened by the screw to urge said switch body so that said positioning portion of said switch body is abutted against said positioning surface.

* * * * *